United States Patent [19]

Vágán

[11] Patent Number: 4,561,607

[45] Date of Patent: Dec. 31, 1985

[54] CABLE DRUM

[75] Inventor: Ferenc Vágán, Kiskunfálegyháza, Hungary

[73] Assignee: Aprillis 4. Gepipari Muvek, Ungarn, Hungary

[21] Appl. No.: 491,974

[22] Filed: May 5, 1983

[51] Int. Cl.[4] ..... B65H 75/14

[52] U.S. Cl. ..... 242/118.4; 242/118.6

[58] Field of Search ..... 242/71.8, 71.9, 117, 242/118, 118.1, 118.4–118.8, 77.3, 77.4, 115, 116

[56] References Cited

U.S. PATENT DOCUMENTS

| | | | |
|---|---|---|---|
| 2,152,522 | 3/1939 | McCann | 242/77.4 |
| 2,909,340 | 10/1959 | Whitaker | 242/115 |
| 2,928,623 | 3/1960 | Mayhew | 242/77.4 |
| 3,565,363 | 2/1971 | Mizuguchi et al. | 242/115 |
| 3,743,208 | 7/1973 | Schmitz | 242/118.8 |

FOREIGN PATENT DOCUMENTS

| | | | |
|---|---|---|---|
| 852352 | 1/1940 | France | 242/118.8 |

*Primary Examiner*—Leonard D. Christian
*Attorney, Agent, or Firm*—Murray Schaffer

[57] ABSTRACT

The invention relates to a cable drum in the sidewalls of which—made of sheet metal—radial waves are formed; the dimensions of the wave increase as they advance from the center towards the flange. The corrugated side of the cable drums can be manufactured in different sizes by using one single tool. The cable drum can be produced either in a rigid, or in a collapsible form. In a folded state the width amounts about ⅛ of the rigid cable drum. For the transport and storage of the folded cable drum a container may be used with an enclosing dimension corresponding to a full cable drum, in which 7–8 folded drums can be transported and stored, respectively.

14 Claims, 13 Drawing Figures

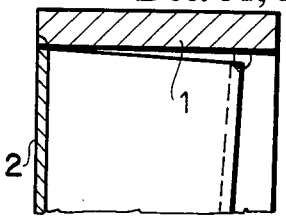
FIG.2A1
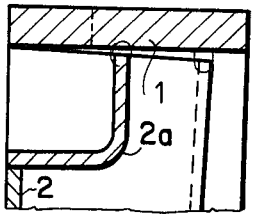
FIG.2A2
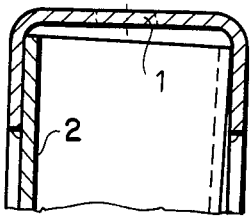
FIG.2A3
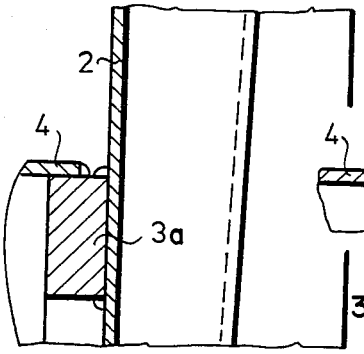
FIG.2B1
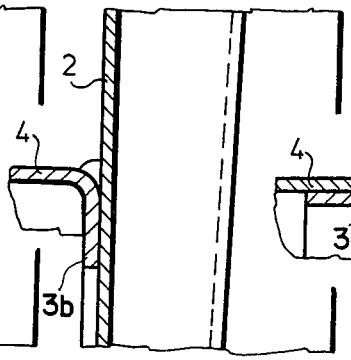
FIG.2B2
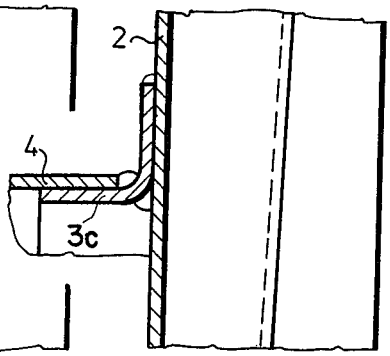
FIG.2B3
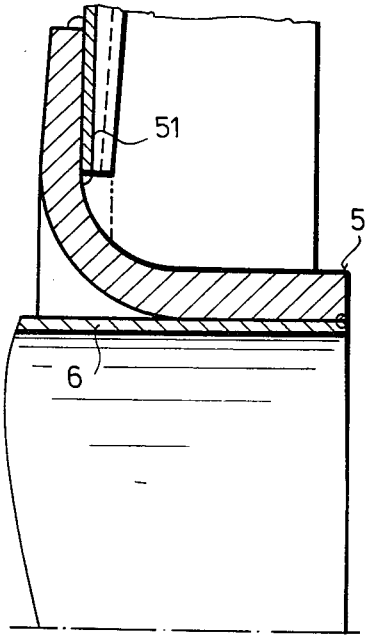
FIG.2C1
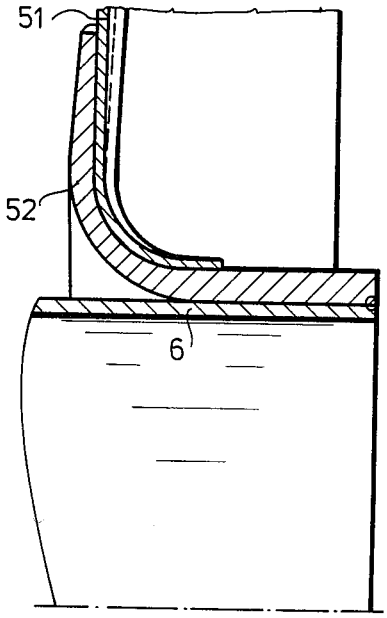
FIG.2C2

CABLE DRUM

BACKGROUND OF THE INVENTION

The present invention relates to a cable drum or reel on which wire, cables or any other endless fibrous material is wound for storage and transport.

The main characteristics, sizes and other requirements regarding the use of cable drums in different fields of industry are based on the standards of each individual country, however, the structure of the cable drums is generally universal. The earliest cable drums were made exclusively of wood, and comprised a carrier cylinder closed by disc-shaped sides. These have been replaced to an ever increasing extent by cable drums made of metal. Two fundamental constructions of the metal drums are used: first, a drum with a flat side and, second, a drum with a corrugated sidewall.

Initially, the disc-shaped plates forming the sidewalls—being similar to those of the wooden drums—were replaced by spokes radiating from the central axis while later, larger diameter sidewalls were made by the reinforcement of the flat plate-like sidewalls with spokes and by extending the spokes to a larger radial distance. The constructions with the flat sides are not now widely used, due to the high expenditure of material and work required to construct them. They are only used for smaller sizes only.

The more widely used construction with the corrugated side represents a far more developed version. In such construction there is arranged, between the carrier cylinder and the axis, i.e. central core, three or more spokes. The outside of the drum is formed by a metal band which is corrugated in such a manner that it has radial ribs lying in concentric circles. The ribs extend beyond the cable carrier cylinder, while in direction of the drum side the size of ribs gradually decreases. The construction can be characterized in that with a smaller diameter, due to the frequency and increased height of the ribs, larger material quantities are accumulated. At the same time, with larger diameters, as the height becomes less, resistance to force effects decreases. It should be mentioned that to each of the differently dimensioned cable drums, sidewalls of different sizes and different corrugations must be prepared, making production even more difficult.

When examining the load of the cable drums in course of use from the point of view of strength, the following statements can be made.

(a) In the course of winding, the cable carrier cylinder, the spokes and the central hub have to carry the gradually increasing mass of cables. In this phase the lateral sidewalls and the flanges are scarely loaded, their only task being to support laterally the cable windings. In the course of unwinding the reverse process takes place.

(b) When storing and transporting the wound cables, the cable carrier cylinder, the sides and flanges have to bear and carry the cable mass. Practical experiences have shown that most damage arise in this phase.

When observing the construction developed to date, it can be seen that the strength of the sidewalls of the cable drum show considerable differences, advancing from the center towards the flange. Next to the overdimensioned parts containing superfluous material, excessively weak, easily damagable parts are to be found which do not meet the strength requirements resulting from the two different loads previously mentioned.

The sidewall is the weakest at the outer flange, just where the load is the highest.

The cable drums with the corrugated side now widely in use have several disadvantageous features from the point of view of manufacturing. For example, in order to press the corrugated sideplates from segments or bands—due to the different flange diameters, drum diameters and wave-number—a plurality of tools are required.

Even where the flange diameter is to be the same, different sidewalls must be manufactured for each drum having a cable carrier cylinder of different diameter.

From the point of view of welding the metal material, welding of the corrugated sidewalls to the cable carrier cylinder by two waveline-shaped welds represents the most critical part of the cable drum, since the different shape of the waves, the number thereof depending on the diameter, make mechanized welding difficult. Welding of the spokes can be mechanized only with great difficulty.

A further difficulty lies in maintaining the sidewalls, to the generatrices of the cable carrier. This requirement is to be met at all means.

Further problems result from storing and transporting the cable drums and appear in connection with their practical use and handling.

Empty cable drums require a large space for storage. Accordingly, it has always been attempted to reduce space requirement by developing cable drums which can be disassembled and reassembled.

The common disadvantage of the known solutions lies in the fact that disassembly and reassembly involve a lot work, the single components of the drum, such as screws may get lost, and at the same time assembly of larger drums may be even dangerous.

Folding drums with more advantageous features are also known, as e.g. those specified in the U.S. Pat. No. 3,791,606 and FR-PS No. 2,047,848; the disadvantage of these cable drums, however, lies in the use of hinges to connect the parts. As a result, in a folded state the hinged arms project at the sides.

The aim of the present invention is to develop a cable drum which is free of the drawbacks mentioned, is light and has a rigid construction. Its structural properties should be such as to comply with the two kinds of load applied, achieving at the flanges of the sidewalls increased strength. The cable drum is to be manufactured in a simple manner by means of relatively few tools, a reduced number of weld seams and is to be prepared in an easily mechanized manner.

A further aim is to insure that, in a folded state, the single elements will not hang over the outer diameter, and that it could be easily folded without the necessity of mounting or demounting components. In a given case it should be provided with a container promoting transport and storage of the folded cable drums.

SUMMARY OF THE INVENTION

In accordance to the present invention, a cable drum is provided having a sidewall made of a flat sheet, which is stiffened by means of radial ribs or corrugations, which ribs are dimensioned so as to increase and spread out proportionally with the diameter and in contrast to present practice with the largest width just at the flange of the drum.

The cable drum according to the present invention, is well suited for winding wires, cables or any other fibrous materials and for the transport and storage thereof. The drum has sidewalls made of sheet metal material and rolling flanges, a cylindrical cable carrier and a central hub. The drum is formed in such a manner that the sidewalls are provided with radially arranged ribs fanning-outwardly from the center. The ribs have a wavy form with a depth and width increasing from the center, outward. The generatrices of the waves are straight, while the cross-sections running perpendicularly to the radius of the sidewall are similar to one another.

In a preferred embodiment of the cable drum according to the invention, the basic material is a flat disc made of sheet material, on which the waves are formed by the uniform lengthening of the material perpendicularly to the radius, by rolling compression or pressing. The number and size of the waves are formed taking into consideration the lengthened material so that the straight sides of the wave join both the plane of the sidewall and the top of the wave parallel thereto with a circular arch with a given radius R.

The cylindrical cable carrier is either a rigid cylinder-jacket, or the series of cable elements pairs replacing the cylindrical jacket and being suitable for folding the cable drum, the drum elements of the pairs being interconnected with the sidewalls by means of hinges. A container is provided capable of receiving more than one folded cable drums, enabling simplified transport.

In the embodiment when folding of the cable drum is made possible, a series of drum element pairs are provided which are axially connected with hinges which have their ends joined to the sidewalls to define a cylindrical surface which in a folded state lie within the perimeter of the sidewall in a recess formed by the corrugation waves, or in any other recess provided for this purpose.

In this embodiment of the invention, the pairs of the elements forming the surface of the cable carrier are connected hingedly in the middle and are displaced radially, when folded. The hinges are fixed in a plane of symmetry, running parallel with the sidewalls of the cable drum on an outer bearing axis—preferably of an annular shape. The inner ends of the drum elements pairs are connected to an inner bearing axis also of annular shape. Overall the drum element pairs are alternatively connected in a lattice-like manner to the hinges relative to the sidewalls.

The invention is described in detail in the following description and is illustrated in the accompanying drawings.

BRIEF DESCRIPTION OF THE DRAWINGS

In the drawings:

FIGS. 2A1–2C2 are a series of details illustrating the manner of forming the connection between the flange and sidewall (A); the sidewall and the carrier cylinder (B) and the sidewall and central core (C)

DESCRIPTION OF THE INVENTION

Figure 1A:
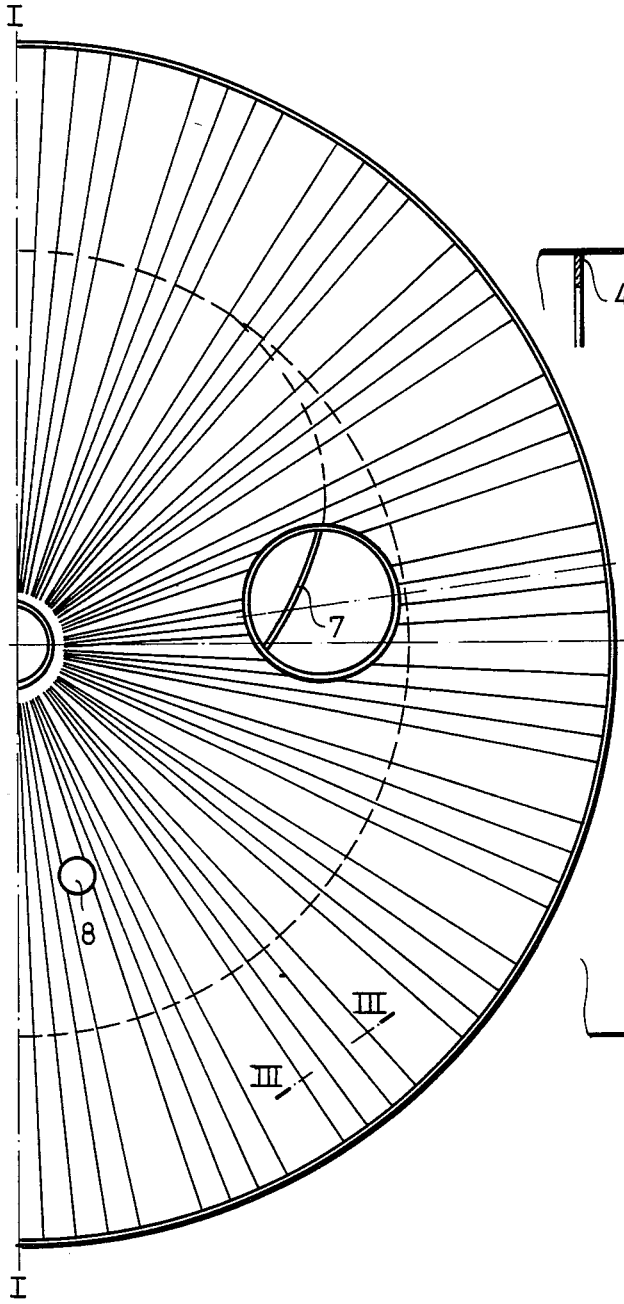
FIG. 1A is a sectional view of half of a non-foldable cable drum, embodying the present invention.
Figure 1B:
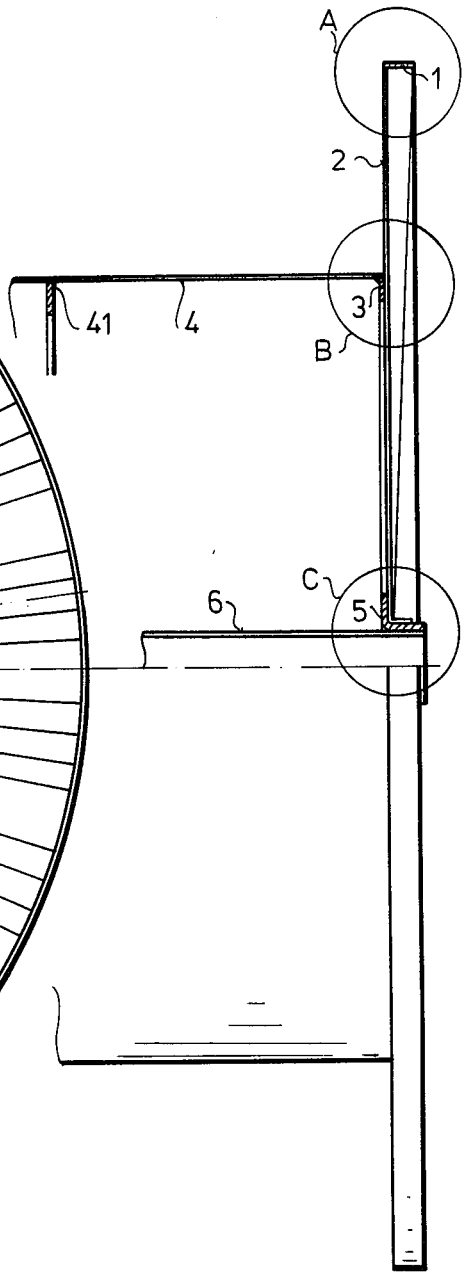
FIG. 1B is a view of the cable drum taken along line I—I of FIG. 1.

As seen in FIG. 1, the cable drum of the present invention comprises a central tubular core shaft 6, at each end of which is mounted a hub 5 having an L-shaped cross-section. Mounted on each hub 5 is a corrugated sidewall 2, the perimeter of which is provided with a flange 1. Coaxial with the central tubular core shaft 6 and spaced radially therefrom is carrier cylinder 4, which is fixed to each of the sidewalls 2. If desired the cylinder 4 is supported along its length by annular braces 41. Each sidewall 2 is provided with an aperture 7, allowing for the fixation of the cable end, and with a smaller hole 8 for receiving the take-up pin by which the drum is rotated.

Figure 3:
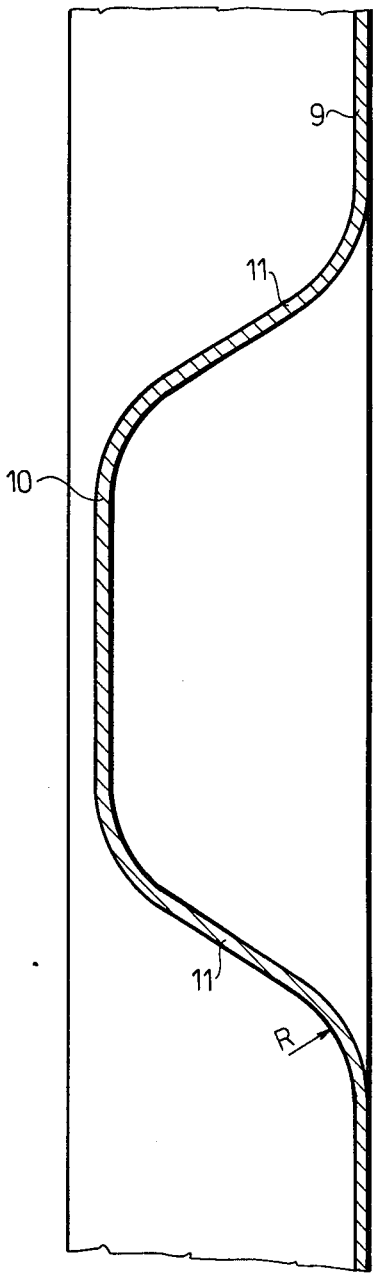
FIG. 3, illustrates a section of the sidewall of the cable drum of FIG. 1 running perpendicularly to the radius, showing the corrugation profile.

In FIG. 2A1 through FIG. 2A3, a series of embodiments show ways in which the flange 1 may attach to the sidewall. In the embodiment of FIG. 2A1 a simple rolling flange or band is welded to the perimetal edge of the sidewall 2. In FIG. 2A2 the same rolling flange is employed, but the sidewall is provided with a circular groove **2*a* for holding the end of the wooden cover used for packing the cables. In FIG. 2A3 the flange has a U-shaped profile overlying the frontal surfaces of the sidewall along the perimetal edge of the sidewall 2**.

In FIGS. 2B1 through FIG. 2B3 a series of embodiments for securing the carrier cylinder 4 to the sidewalls is shown. In FIG. 2B1 an annular support ring **3*a* is welded to both the cylinder 4 and sidewall 2. In FIG. 2B2 the end of the cylinder 4 is bent inwardly to form an integral flange 3*b* which is welded to the sidewall. In FIG. 2B3 an L-shaped bracket 3*c* is welded to the sidewall forming a horizontal support for the cylinder 4** to which it may also be welded.

In FIGS. 2C1 and FIG. 2C2 the manners by which the central core and hub 5 may be fashioned are illustrated. In FIG. 2C1 an annular disc 51 is interposed between the sidewall 2 and an L-shaped hub 5. In FIG. 2C2 the sidewall is bent inwardly at the hub and the hub is tapered as at 52 adjacent the disc 51 conforming thereto. The parts are welded together along the planar surface of the disc 51 and the top of the wave or corrugation of the sidewall. The hub 5 is welded to the disc 51 and the core 6. Thus, welds conforming to the wave of the rib are avoided.

The parts are preferably formed of sheet metal material, although suitably high impact and high strength plastic may be employed.

The basic material of the corrugated sidewall 2 may be a disc made of flat sheet material, on which the waves or corrugations according to the invention are formed by lengthening the material in fan like manner, through permanent deformation by axial or rolling compression. The shape and number of the waves is selected so that, at the end of the pressing procedure, extension of the material at any point in the fan does not coincide with the beginning of contraction of the material from which it is extended. That is the sheet is to maintain a uniform thickness after compression. Such a cross-section is to be seen in FIG. 3, where the side of each rib 11 is connected, by circular arcs having a radius R, to the top 10 of the wave forming the rib and to the plane 9 of the flat sheet from wherein the sidewall is formed. The ribs or corrugations are pressed out from one side of the starting sheet metal material so that one side maintain the plane 9, and the ribs taper along their length both circularly (tranverse to the radius as well as along the radius outward from the central core 6 to have their largest height, width at the perimetal edge where the flange 1 is attached, see FIG. 1B.

The original sheet material can be completely annular or a sector-shaped sheet segment, in which case the entire sidewall has to be built-up from an appropriate number of corrugated segments, welded together.

With the solution according to the present invention, a single corrugating tool or die can be prepared and used to form a sidewall of the largest diameter and thickness desired to be produced and which is fixed onto the press. Thereafter, this tool is useable to form any smaller sized sidewall—with optional diameter and thickness, since the wave-profile chosen, in any event in accordance with strength requirements proportionally decreases toward the center of the sidewall so that the center is identical for all sidewalls and ceases at the center hub, cable drum sidewalls can be prepared in any desired diameter up to the maximum size of the tool, and tolerating loads normal in the course of use.

Figure 4:
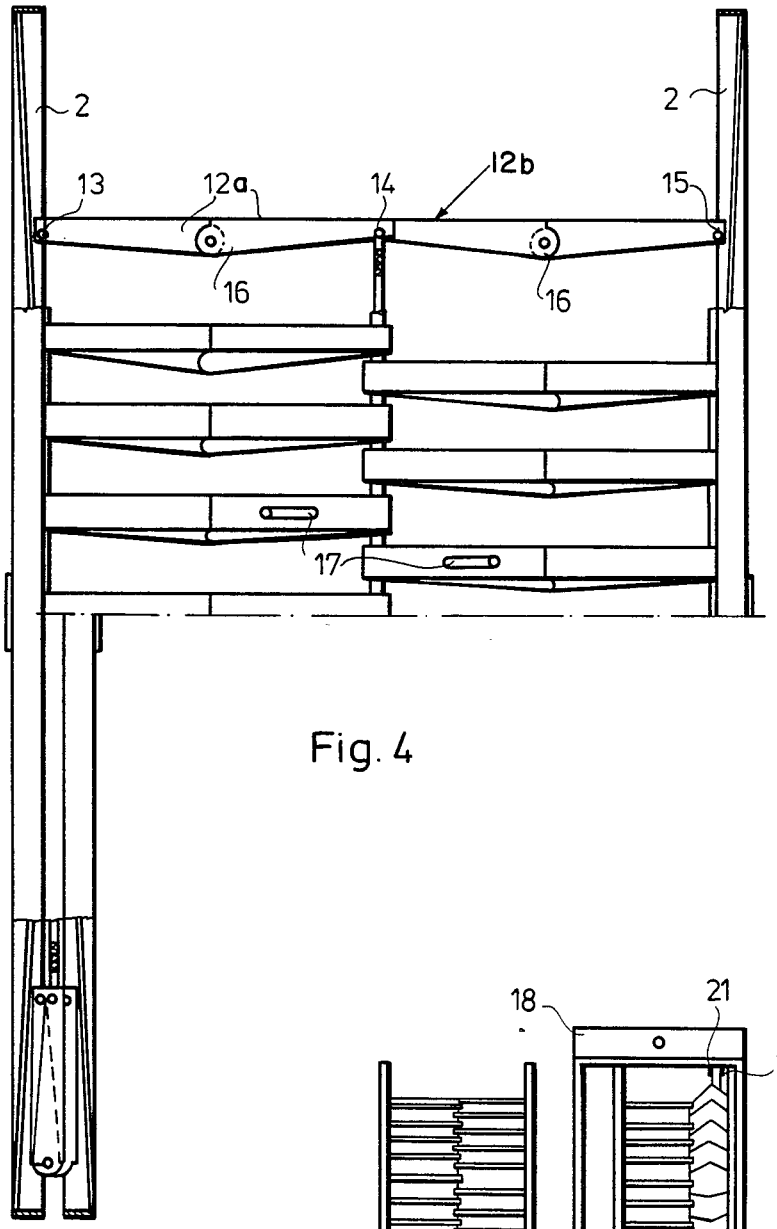
FIG. 4 is a front view showing in the upper half an open foldable cable drum and in the lower half a cable drum folded.

In the other embodiment of the invention, the same sidewall structure disclosed above, can be employed with a foldable cable drum. As seen in FIG. 4, the cable carrier cylinder is formed by a plurality of articulated drum element pairs 12*a* and 12*b*. Each drum element pair comprises two arms, each having an U-shaped cross section and connected in the middle with the hinge 16, so that when folded the elements bend down and intertwine. According to the example illustrated in FIG. 4, the element pairs of the drum elements are strung in a lattice-like manner with the pairs 12*a* circumferentially offset from the pairs 12*b* to define a cylindrical body of rotation about the central axis. The outer ends of each element pairs are hingedly connected about an annular bearing axis (i.e. hoop) 13 & 15 formed on the opposing sidewalls, respectively, and at their inner ends about a similar annular bearing axis (i.e. hoop) 14 arranged coplanar to sidewalls. The hinges may be fixed to the sidewall e.g. by welding. Premature folding of the open cable drum may be prevented by bolts 17 movable into position to block folding about the hinge 16.

When folding the cable drum, the middle arm of the pairs 12 (hinged at 16) moves radially outward towards the flange of the cable drum allowing sidewalls 2 to approach one another. The arms connected around the hinge 16 fold into each other and lie in the recess formed by a rib or corrugation in the sidewalls 2 with the widest parts next to the flange. In such a manner the width of the cable drum can be reduced about to $\frac{1}{8}$ of the original volume.

Figure 5:
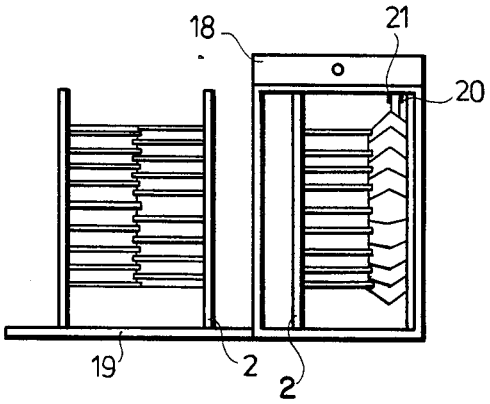
FIG. 5, is a schematic view of a container for the transport and storage of the cable drum.

As seen in FIG. 5, the folded cable drum may be placed in the properly shaped container 18, the dimensions of which correspond, for example, the size of an open drum. The container 18 is provided with the let-down sidewall 19, as well as with the tongues 20, 21 fixing the cable drums in position by fitting over the flange 1 of the cable drums in position by fitting over the flange 1 of the cable drum, and the folded edges of the collapsible arms 12*a* and 12*b*, as seen in FIG. 5, one half of a drum in partially collapsed condition axially of the container.

In the course of transport, a full drum can be initially delivered in a container 18, while the others are transported in a traditional manner. After having used the cable from the drum initially housed in the container, the empty cable drum together with several others is folded and reinserted into the container.

It is obvious from the embodiment described that the corrugated sidewall with the radial ribs with a proportionally increasing profile from the center towards the flange assures a light and stiff structure while simultaneously achieving the proper strength at the end of the flange. The cable carrier cylinder, may be selected with any desired diameter having the same corrugated sidewall and flange diameter.

A special advantage lies in the fact that a wide number of cable drums can be manufactured in only a small number of series. Since the corrugated sidewalls can be prepared by means of one single tool, which has to be chocked or set in the press only once, various diameter pieces can be made in a single pressing procedure, from any usual sheet material. All welding seams of the cable drum can be prepared in a mechanized manner.

By having folding drums, it becomes possible to transport and to store 7–8 drums instead of one in a single container enabling a most economical manipulation of the cable drums and considerable saving in labor and energy.

I claim:

1. A drum for cables, wires or any other endless fibrous material comprising a cylindrical cable carrier having secured at each end a circular sidewall, each of said sidewalls comprising a disc formed of sheet material having an inner and outer surface, a central hole and a circular perimeter, said sheet material being shaped to have a plurality of radially arranged corrugations forming ribs extending from the central hole to said perimeter and outwardly from one of said surfaces, each rib having a uniformly increasing depth and width from the center outward, and a radially straight generatrix, wherein each cross-section perpendicular to the radius at the same extent of the sidewall is similar to one another.

2. The drum according to claim 1, wherein said side wall comprises a plurality of coplanar segments between which each rib is formed, said ribs extending from one surface of said sidewall and presenting in cross section a flat top and a pair of sides, each of said sides being connected by a circular arc of identical radius to said one surface of the sidewall, and said flat top running parallel with said one surface in the radial direction.

3. The drum according to claim 1 wherein each rib, in the cross-section lying perpendicularly to the radius, has the shape of a wave.

4. The drum according to claim 1 wherein the sidewalls are formed of a plurality of sector-shape segments jointed integrally, each segment being provided with one or more ribs.

5. The drum according to claim 1 wherein each of said sidewalls includes a central hole, an L-shaped bracket fitting within said hole and having one leg parallel to the surface of said sidewall and a flat washer interposed between said sidewall and said one leg, said leg, washer and sidewall being welded integrally.

6. A foldable drum for cables, wires, or any other endless fibrous material comprising a cylindrical cable carrier secured at each end to a circular sidewall, said cylindrical cable carrier comprising a plurality of articulating coupled arm pairs arranged about the central axis to define a cylindrical body, said arm pairs being arranged in two annular rows parallel to said sidewalls, the arm pairs in one row being circumferentially offset from those in the other row and having their free inner ends pivotally connected in a first annular bearing axis parallel to said sidewalls, and having their free outer ends pivotally connected in a second annular bearing axis formed on each of said sidewalls, whereby when said hinged arm pairs are displaced radially, said arm pairs are folded in the symmetry plane running parallel with the sidewalls.

7. The foldable drum according to claim 6 wherein each of said sidewalls is corrugated to provide a plurality of radially arranged ribs, each having a recess adapted to receive an associated one of the arm pairs when folded.

8. The foldable drum according to claim 6 including bolt means movable between each of said arms in each pair to prevent collapse of said arm pair about said couple.

9. The foldable drum according to claim 6 wherein each of said ribs have a uniformly increasing depth and width from the center outward and a radially straight generatrix wherein each cross-section perpendicular to the radius is similar to one another.

10. The drum according to claim 6, wherein said side wall comprises a plurality of coplanar segments between which each rib is formed, said ribs extending from one surface of said sidewall and in cross section a flat top and a pair of sides, each of said sides being connected by a circular arc of identical radius to said one surface of the sidewall, and said flat top running parallel with said one surface in the radial direction.

11. The drum according to claim 6, wherein each rib, in the cross-section lying perpendicularly to the radius, has the shape of a wave the profile of which is gained by the extension of the material of the same extent.

12. The drum according to claim 6, wherein the sidewalls are formed of a plurality of sector-shape segments jointed integrally, each segment being provided with one or more ribs.

13. The drum according to claim 6, wherein each of said sidewalls includes a central hole, an L-shaped bracket fitting within said hole and having one leg parallel to the surface of said sidewall and a flat washer interposed between said sidewall and said one leg, said leg, washer and sidewall being welded integrally.

14. In combination with the folable drum according to claim 6, a container, comprising a housing adapted to hold at least one extended open drum and a plurality of folded drums, said housing have means on the interior thereof engaging and holding the sidewall of said drum.

* * * * *